US010562204B2

(12) United States Patent
Nordlin

(10) Patent No.: US 10,562,204 B2
(45) Date of Patent: Feb. 18, 2020

(54) DIE WITH PROFILED BASE WALL

(71) Applicant: Greenlee Textron Inc., Rockford, IL (US)

(72) Inventor: William F. Nordlin, Poplar Grove, IL (US)

(73) Assignee: GREENLEE TOOLS, INC., Rockford, IL (US)

( * ) Notice: Subject to any disclaimer, the term of this patent is extended or adjusted under 35 U.S.C. 154(b) by 48 days.

(21) Appl. No.: 15/193,575

(22) Filed: Jun. 27, 2016

(65) Prior Publication Data

US 2016/0303754 A1 Oct. 20, 2016

Related U.S. Application Data

(62) Division of application No. 13/874,022, filed on Apr. 30, 2013, now Pat. No. 9,393,607.

(51) Int. Cl.
*B26F 1/14* (2006.01)
*B21D 28/24* (2006.01)
(Continued)

(52) U.S. Cl.
CPC ..... *B26F 1/14* (2013.01); *B21D 28/24* (2013.01); *B21D 28/34* (2013.01); *B26F 1/386* (2013.01);
(Continued)

(58) Field of Classification Search
CPC ..... B26F 1/14; B26F 1/386; Y10T 83/9428; Y10T 83/9476; Y10T 83/9432;
(Continued)

(56) References Cited

U.S. PATENT DOCUMENTS 2,031,024 A * 2/1936 Ahlquist ..... B21D 28/34 470/197
2,145,725 A 1/1939 Jamieson
(Continued)

FOREIGN PATENT DOCUMENTS

EP 1340559 A2 9/2003
EP 2 208 553 A2 7/2010

OTHER PUBLICATIONS

Communication for corresponding EP Application No. 14166006.8 dated Nov. 4, 2016, 5 pages.
(Continued)

*Primary Examiner* — Laura M Lee
(74) *Attorney, Agent, or Firm* — Klintworth & Rozenblat IP LLP

(57) ABSTRACT

A die is configured for use with a punch capable of piercing and cutting a workpiece. The die includes a base wall having a perimeter, an outer surface and an inner surface, a depending wall extending from the perimeter, a passageway extending through the base wall, and a central axis extending through the passageway. The outer surface of the base wall is perpendicular to the central axis. The inner surface of the base wall has a first portion which is angled relative to the central axis at a first angle which is greater than 90 degrees, and a second portion which is angled relative to the central axis at a second angle which is greater than 90 degrees. The first and second angles are different. The first portion extends from the depending wall to the second portion. The second portion extends from the first portion to the passageway. The second portion engages the punch when the punch is fully inserted into the die.

6 Claims, 5 Drawing Sheets

(51) Int. Cl.
*B26F 1/38* (2006.01)
*B21D 28/34* (2006.01)

(52) U.S. Cl.
CPC ..... *Y10T 83/9425* (2015.04); *Y10T 83/9428* (2015.04); *Y10T 83/9437* (2015.04)

(58) Field of Classification Search
CPC ..... Y10T 83/9435; Y10T 83/9423; Y10T 83/9425; B21D 28/24; B21D 28/243; B21D 28/246
USPC .... 30/360, 366; 83/685, 686, 688, 689, 662; 72/358, 359, 330
See application file for complete search history.

(56) References Cited

U.S. PATENT DOCUMENTS

| | | | | | |
|---|---|---|---|---|---|
| 2,212,886 | A * | 8/1940 | Ruland | B21D 28/34 | 470/162 |
| 2,652,942 | A * | 7/1949 | Munchy | 29/505 | |
| 3,255,526 | A | 6/1966 | Victor | | |
| D241,269 | S * | 8/1976 | Fentzke | D15/136 | |
| 4,353,164 | A | 10/1982 | Linguist et al. | | |
| 4,543,722 | A | 10/1985 | Adleman et al. | | |
| 4,905,557 | A | 3/1990 | Adleman | | |
| 5,727,436 | A | 3/1998 | Swedberg et al. | | |
| 6,973,729 | B2 | 12/2005 | Nordlin | | |
| 8,201,433 | B2 * | 6/2012 | Kanie | B21D 28/26 | 72/335 |

OTHER PUBLICATIONS

Extended European Search Report for EP Application 14166006.8 dated Sep. 14, 2014, 8 pages.

* cited by examiner

DIE WITH PROFILED BASE WALL

This application is a divisional application of Ser. No. 13/874,022, filed on Apr. 30, 2013, the contents of which are incorporated herein in its entirety.

FIELD OF THE INVENTION

The present invention relates to a die having a base wall having a profile that generally matches the profile of at least a portion of a leading edge of a punch.

BACKGROUND OF THE INVENTION

Punches and their associated dies have been used for decades in construction and industry to make holes in workpieces, such as sheet metal, for field installation of electrical, plumbing, and heating/AC equipment.

FIGS. 1-4 show a prior art punch 10 which is used for punching a hole through a workpiece, such as sheet metal. This punch 10 is disclosed in U.S. Pat. No. 4,543,722, the disclosure of which is incorporated herein by reference in its entirety. The punch 10 is used with a die 40 (only partially shown in FIG. 3) which is well-known in the art, as well as a draw shaft (not shown).

The punch 10 has a contoured working face 14 which reduces the peak punching force by first piercing the workpiece and then shearing the circumference of the hole. The contoured working face 14 of the punch 10 has a profiled leading edge 29, which includes piercing points P1, P2 and cutting surfaces 30*b*, 32*b*, which causes the slug or scrap which is punched in the workpiece to be torn in half, making it easy for the slug or scrap to be removed from the die 40.

The die 40 has a circular planar base wall 42 with a circular depending wall 44 extending from the perimeter of the base wall 42. A central passageway 46 extends through the axial center of the base wall 42. The size of the die 40 is dictated by the size of the punch 10 used.

If the punch 10 is advanced too far into the die 40, the leading edge 29 of the punch 10 "bottoms" in the die 40, i.e., the punch points P1, P2/cutting surfaces 30*b*, 32*b* come into contact with the base wall 42 of the die 40, and damage to the punch points P1, P2/cutting surfaces 30*b*, 32*b* can result. Actuation of the punch 10/die 40 with an electric or power hydraulic device can advance the punch 10 so rapidly that the user may not stop the punching cycle before the punch 10 "bottoms" in the die 40. For this reason, manufacturers of punches/dies have long recommended only manual actuation of the punches/dies with a wrench. Use of electrohydraulics has been discouraged to prevent damage to the punch.

Mechanical and electrical contractors are seeking ways to reduce the time for field installation of conduit, pipe, and round ductwork. As a result, power punching of holes in sheet metal is increasingly replacing the traditional manual wrench methods.

Punches and their associated dies are sold separately from the various battery, electric, hydraulic and mechanical devices which are used to actuate the punch relative to the die. There are battery and corded electric hydraulic pump/ram tools which attempt to stop the advancing of the punch when an internal pressure sensor detects the drop in force when the punching cycle is complete. These pressure drop sensors tend not to be completely reliable on thinner steels, softer materials (i.e. copper, aluminum), and for smaller hole diameters. Punching systems which incorporate an internal pressure sensor are expensive and may be justifiable only for larger construction jobs. In addition, many electricians make use of their existing all-purpose industrial hydraulic pumps without the pressure drop sensor to actuate knockout punches.

A punch and die are provided herein which has integral cutting edge protection which is independent of the various power driving systems. Other features and advantages of the present die will become apparent upon a reading of the attached specification, in combination with a study of the drawings.

SUMMARY OF THE INVENTION

A die is configured for use with a punch capable of piercing and cutting a workpiece. The die includes a base wall having a perimeter, an outer surface and an inner surface, a depending wall extending from the perimeter, a passageway extending through the base wall, and a central axis extending through the passageway. The outer surface of the base wall is perpendicular to the central axis. The inner surface of the base wall has a first portion which is angled relative to the central axis at a first angle which is greater than 90 degrees, and a second portion which is angled relative to the central axis at a second angle which is greater than 90 degrees. The first and second angles are different. The first portion extends from the depending wall to the second portion. The second portion extends from the first portion to the passageway. The second portion engages the punch when the punch is fully inserted into the die.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENTS

Figure 1:
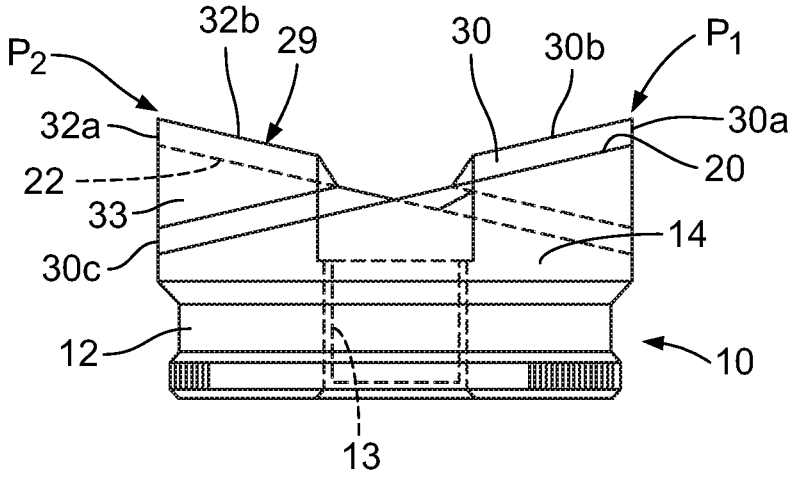
FIG. 1 Prior Art
FIG. 1 is a side elevation view of a prior art punch.
Figure 2:
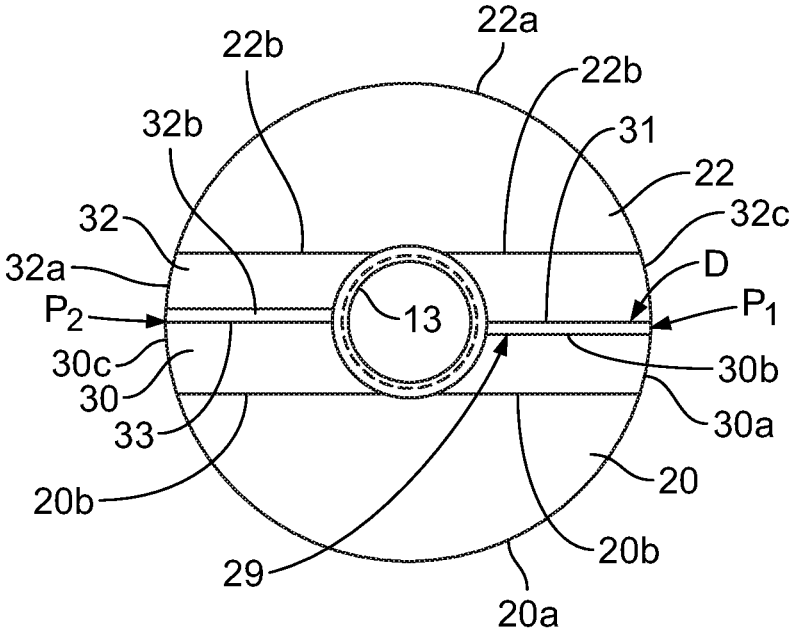
FIG. 2 Prior Art
FIG. 2 is a top plan view of the prior art punch.
Figure 3:
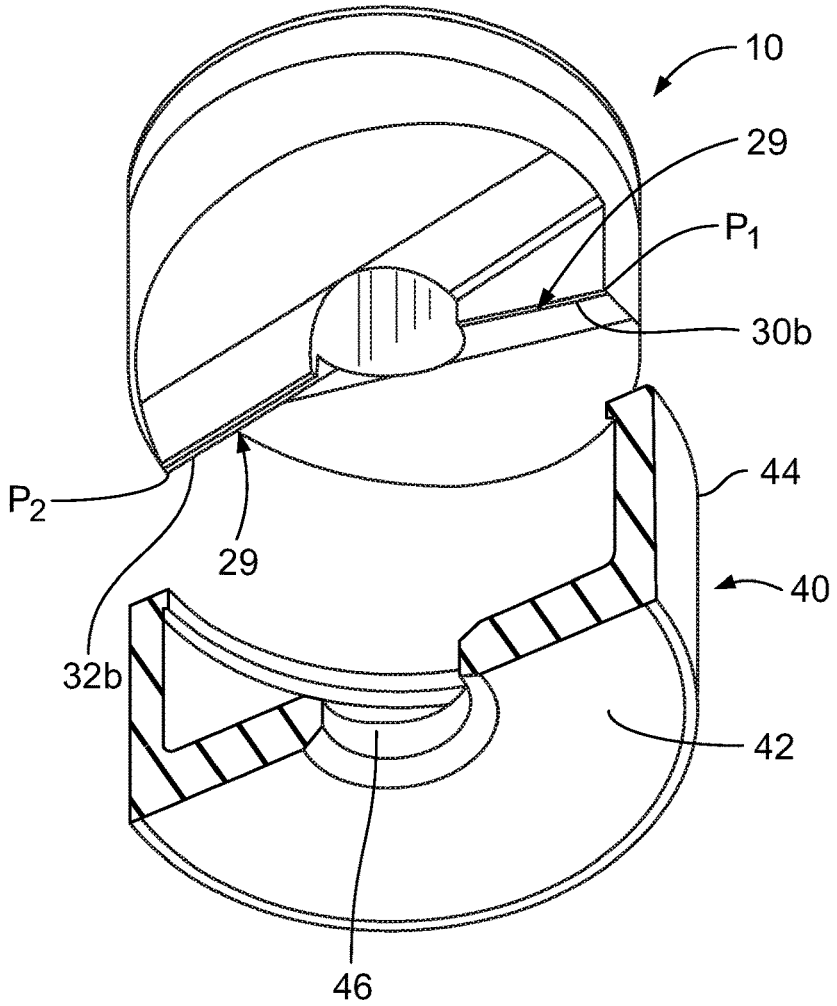
FIG. 3 Prior Art
FIG. 3 is a perspective view of the prior art punch, along with a prior art die which is only partially shown.
Figure 4:
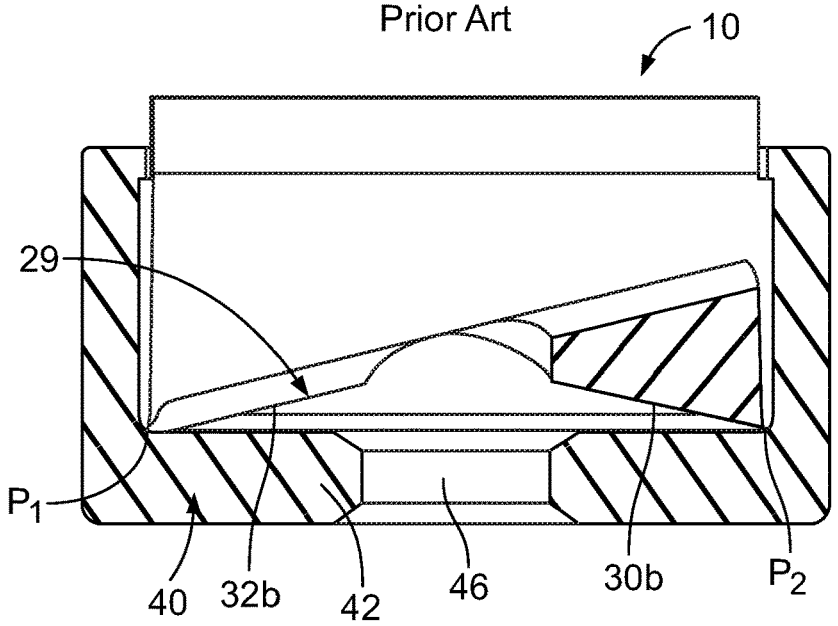
FIG. 4 Prior Art
FIG. 4 is a cross-sectional view of the prior art punch engaged with the prior art die.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein. Therefore, unless otherwise noted, features disclosed herein may be combined together to form additional combinations that were not otherwise shown for purposes of brevity.

Figure 5:
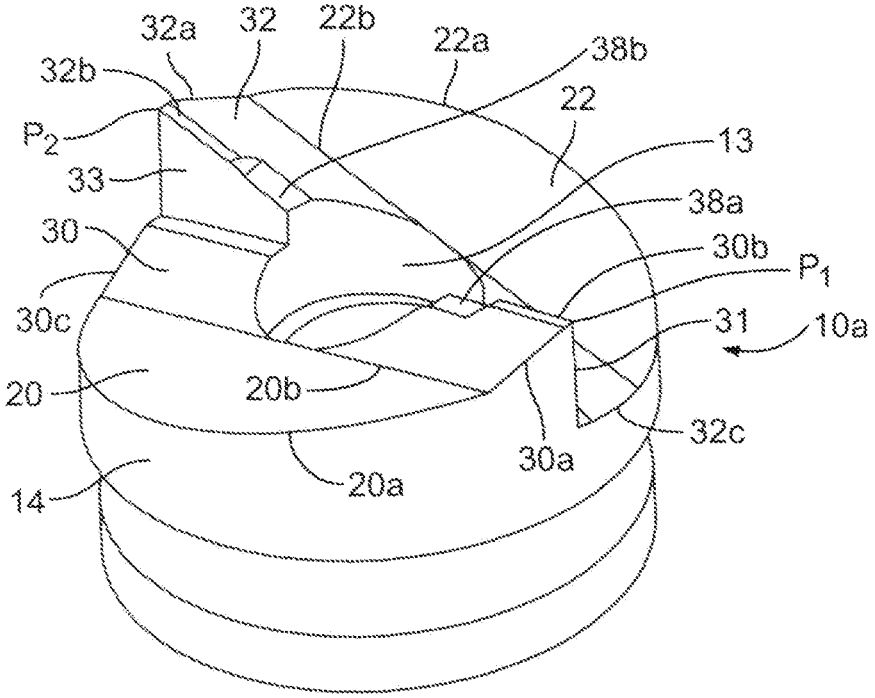
FIG. 5 is a perspective view of a punch which incorporates the features of the present invention.
Figure 6:
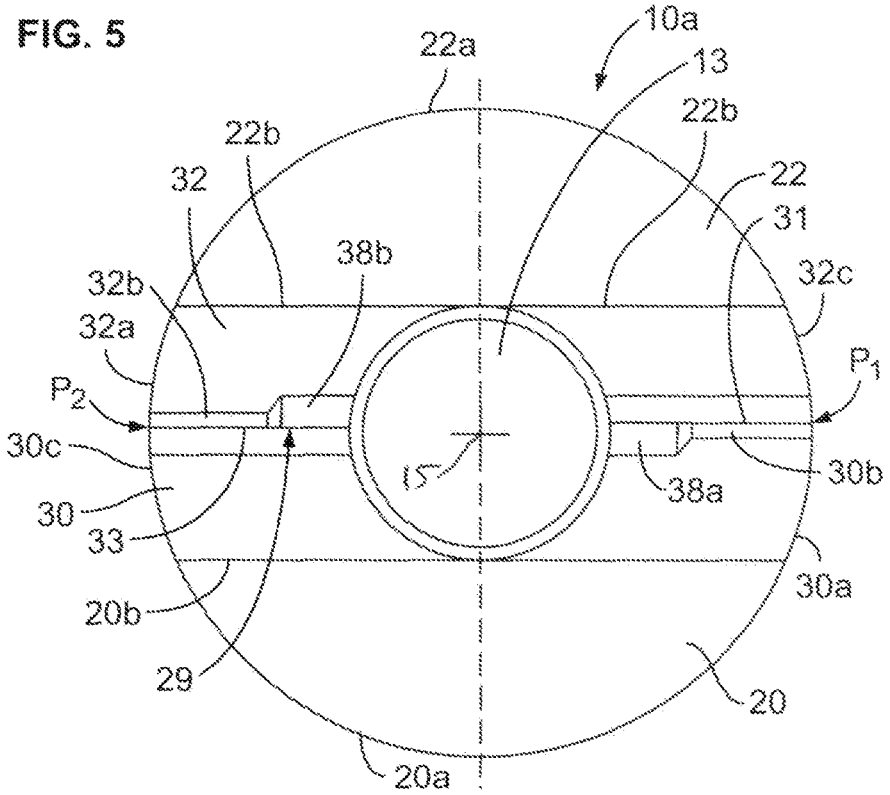
FIG. 6 is a top plan view of the punch of FIG. 5.
Figure 7:
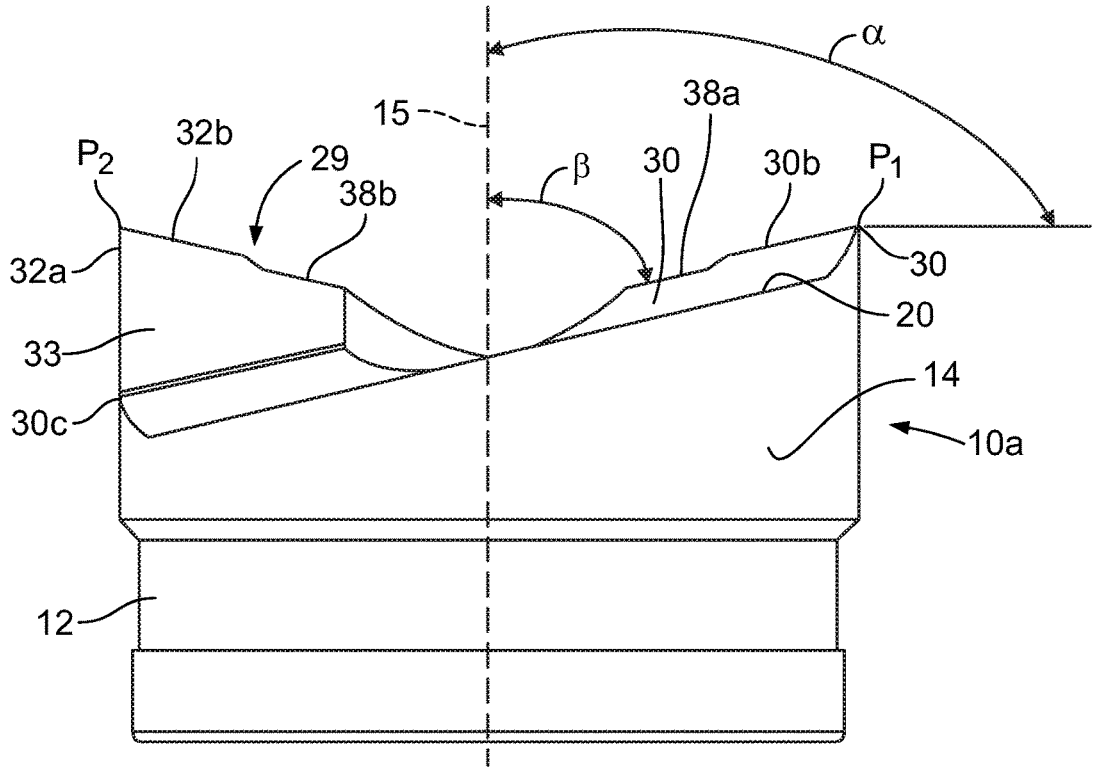
FIG. 7 is a side elevation view of the punch of FIG. 5.

FIGS. 5-7 show the punch 10*a* which is used for punching a hole through a workpiece, such as sheet metal. In the present invention, the punch 10*a* has a profiled leading edge 29 and is used with a novel die 60, as well as a draw shaft (not shown). The punch 10*a* is identical to the prior art punch 10 shown in FIGS. 1-4, with the exception of inclined engaging surfaces 38*a*, 38*b* on the leading edge 29 as disclosed herein, and therefore, like reference numerals are used for the punch 10*a* as are used in the punch 10.

The punch 10*a* shown and described herein is illustrative of a type of punch that can be used in the present invention. It is to be understood that the specifics of the leading edge 29 described herein is not limiting, and that other leading edges than that shown and described can be used. The critical aspect of the present invention is that the profile of at least a portion of an inner surface 72 of the base wall 62 of the die 60 substantially conforms in shape to the engaging surfaces 38*a*, 38*b* of the leading edge 29 of the punch 10*a*.

The illustrative punch 10*a* is formed of metal and includes a generally cylindrical punch body 12 having a threaded bore 13 extending axially therethrough for threadably receiving the threaded end of the draw shaft in a conventional manner. The punch 10*a* includes a contoured working face 14 transverse to its axis 15 which is used for punching and splitting a slug or scrap from the workpiece. The contoured working face 14 includes a pair of first inclined planar surfaces 20, 22 on opposite sides of the bore 13. The first planar surfaces 20, 22 slope upwardly from the working face 14 in opposite directions. The first planar surfaces 20, 22 have outer circumferential or peripheral edges which form first outer cutting edges 20*a*, 22*a* around a large portion of the periphery of the working face 14 when viewed in plan as shown in FIG. 6. The planar surfaces 20, 22 also have inner chordal ends 20*b*, 22*b* parallel with and spaced from diameter across the working face 14 in plan view. These chordal ends 20*b*, 22*b* are intersected by a pair of second inclined planar surfaces 30, 32. The second inclined planar surfaces 30, 32 slope upwardly from the lines of intersection at a steeper angle of inclination than the first planar surfaces 20, 22.

The second inclined planar surfaces 30, 32 include outer peripheral edges forming second outer circumferential edges 30*a*, 32*a* and third cutting edges 30*c*, 32*c* around a small portion of the periphery of the working face 14 when viewed in plan. The second inclined planar surfaces 30, 32 terminate laterally across the working face 14 on one side of the bore 13 between the first inclined planar surfaces 20, 22 in narrow lateral cutting surfaces 30*b*, 32*b* which are generally flat across and in vertically and radially oriented third surfaces 31, 33 on the other side of the bore 13 between the first inclined planar surfaces 20, 22. Each cutting surface 30*b*, 32*b* extends at angle a, which is preferably 77°, relative to the central axis 15. Each third surface 31, 33 extends vertically upward at a 90° angle from the respective second inclined planar surface 30, 32 and terminates at the respective lateral cutting surface 30*b*, 32*b*. The lateral cutting surfaces 30*b*, 32*b* extend generally toward one another and incline upwardly in opposite directions toward the associated second outer cutting edges 30*a*, 32*a* of the second inclined planar surfaces 30, 32. The lateral cutting surfaces 30*b*, 32*b* thus form a generally V-shaped lateral cutting means across the working face 14 when viewed in elevation.

Piercing points P1, P2 are formed on diametrically opposite sides of the periphery of the working face 14 at the junction of the lateral cutting surfaces 30*b*, 32*b* with the respective second cutting edges 30*a*, 32*a*. The piercing points P1, P2 initially pierce the workpiece in a triangular pattern and initiate lateral cutting across the slug diameter before a substantial portion of the slug circumference is cut. The uppermost height of the second cutting edges 30*a*, 32*a* above the respective first cutting surfaces 20*a* and 22*a* as well as their angle of slope and length (circumferential) is correlated with similar parameters for lateral cutting surfaces 30*b*, 32*b* to achieve this effect.

The punch 10*a* differs from the prior art punch 10 shown in FIGS. 1-4 in that a pair of inclined engaging surfaces 38*a*, 38*b* are provided. The engaging surfaces 38*a*, 38*b* extend from the bore 13 to the lateral cutting surfaces 30*b*, 32*b*. The engaging surfaces 38*a*, 38*b* are wider than the lateral cutting surfaces 30*b*, 32*b* such that the engaging surfaces 38*a*, 38*b* extend from the third surfaces 31, 33 past the edge of the cutting edges 30*b*, 32*b* and into the second inclined planar surfaces 30, 32. The engaging surfaces 38*a*, 38*b* preferably extends at angle β which is preferably 77°, relative to the central axis 15. The engaging surfaces 38*a*, 38*b* are axially offset from the cutting surfaces 30*b*, 32*b*. The engaging surfaces 38*a*, 38*b* extend generally toward one another and incline upwardly in opposite directions toward the associated second outer cutting surfaces 30*b*, 30*b*.

Figure 8:
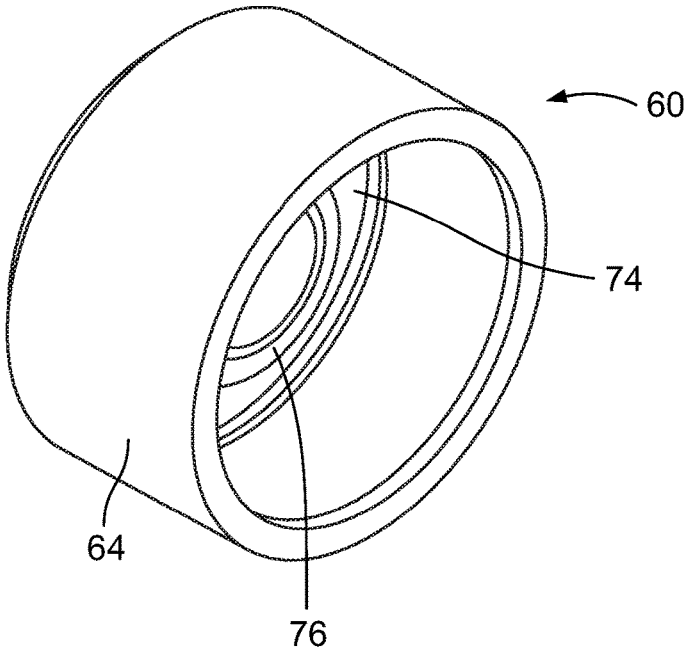
FIG. 8 is a perspective view of a die which incorporates the features of the present invention.
Figure 9:
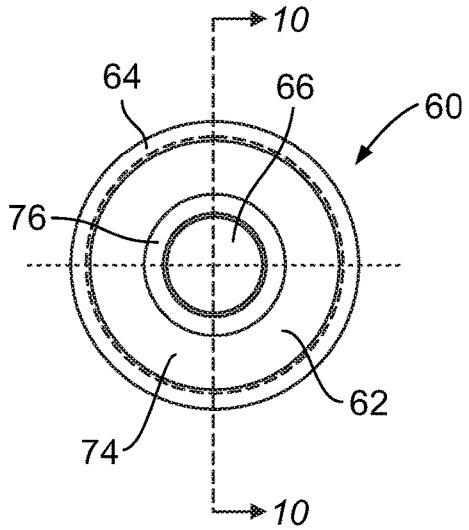
FIG. 9 is a top plan view of the die of FIG. 8.
Figure 10:
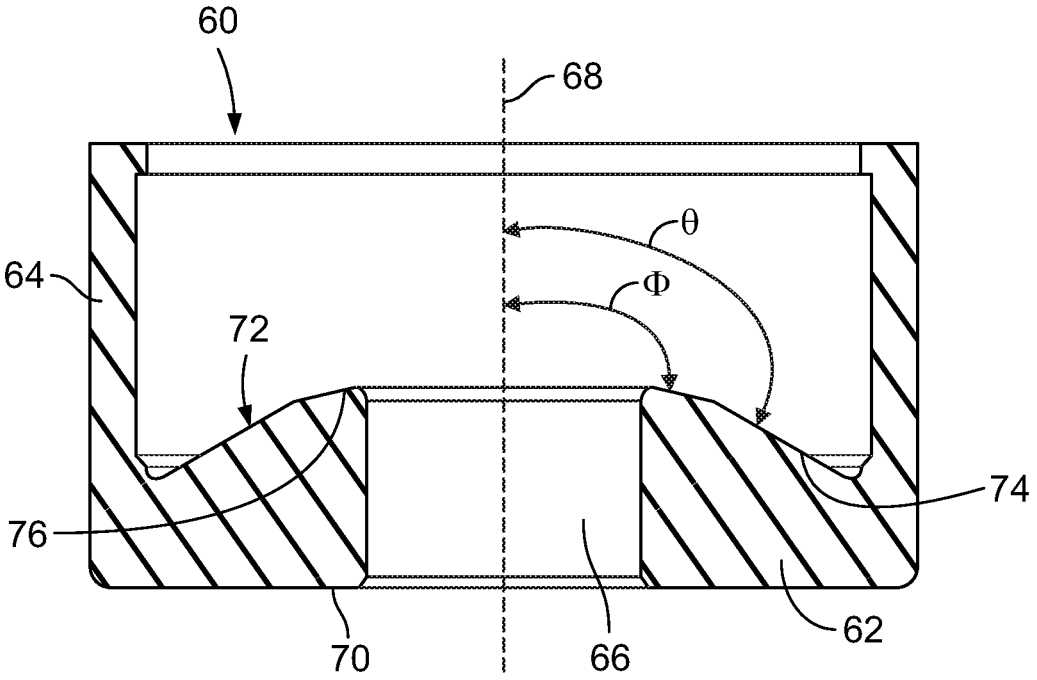
FIG. 10 is a cross-sectional view along line 10-10 of FIG. 9.

As shown in FIGS. 8-10, the die 60 is formed of metal and has a base wall 62 with a circular depending side wall 64 extending from the perimeter of the base wall 62. A central passageway 66 extends through the axial center of the base wall 62 and has a first end at the outer surface 70 of the base wall 62 and a second end at the inner surface 72 of the base wall 62. A central axis 68 extends through the axial center of the central passageway 66. The outer surface 70 of the base wall 62 is planar and perpendicular to the axis 68 and the inner surface 72 of the base wall 62 is contoured. The inner surface 72 has a first inclined surface 74 and a second inclined surface 76. The first inclined surface 74 extends from the juncture of the depending wall 64 to the second inclined surface 76 at an angle θ, which is preferably 120°, relative to the central axis 68 of the die 60. The second inclined surface 76 extends from the first inclined surface 74 to the central passageway 66, at an angle Φ which is preferably 103° relative to the central axis 68 of the die 60. The size of the die 60 used is dictated by the size of the punch 10*a* used.

The angle at which the second inclined surface 76 of the die 40 is provided and the shape of the second inclined surface 76 mirrors the angle at which the engaging surfaces 38*a*, 38*b* of the punch 10*a* are provided and the shape of the engaging surfaces 38*a*, 38*b*, such that the second inclined surface 76 and the engaging surfaces 38*a*, 38*b* mate when the punch 10*a* is fully inserted into the die 60. The piercing points P1, P2, the cutting surfaces 30*b*, 32*b* and the engaging surfaces 38*a*, 38*b* form the leading edge 29 of the working face 14 when the punch 10*a* is inserted into the die 40.

Figure 11:
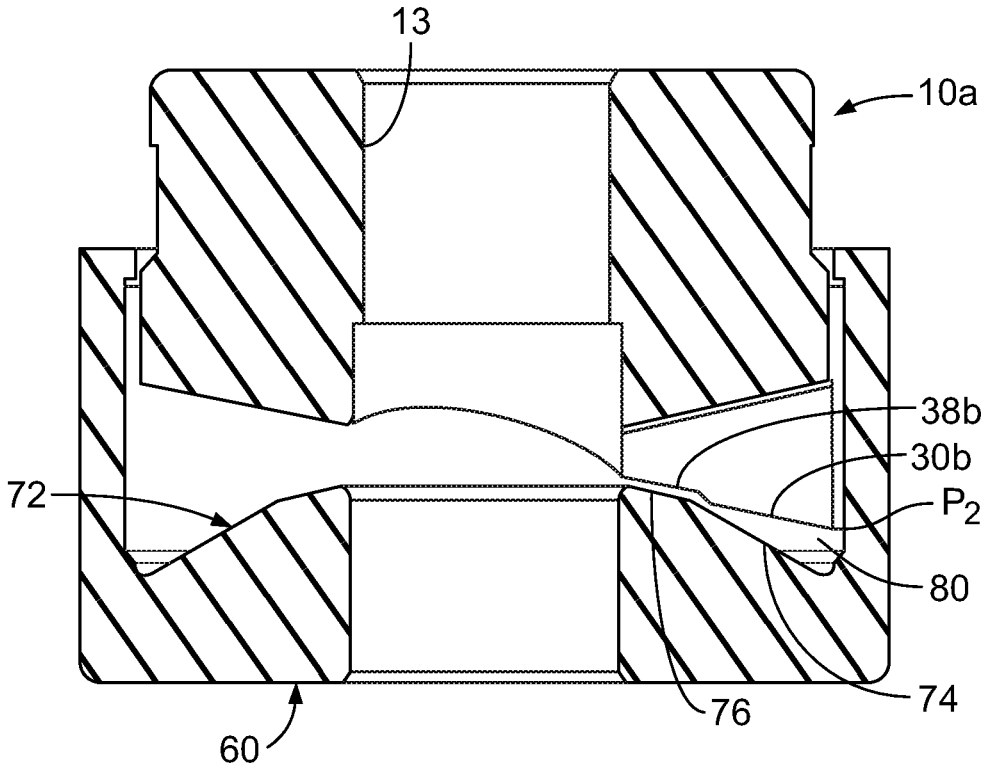
FIG. 11 is a cross-sectional view of the punch of FIG. 5 engaged with the die of FIG. 8, in the position just before the punch "bottoms" out on the die.

FIG. 11 shows the punch 10*a* just before "bottoming" out on the die 60, that is, when the punch 10*a* is driven too far into the die 60, i.e., advancement of the punch 10*a* is not stopped before the leading edge 29 of the punch 10*a* contacts the base wall 62 of the die 60 and the punch 10*a* "bottoms" out on the die 60. When the punch 10*a* bottoms out on the die 60, the engaging surfaces 38*a*, 38*b* engage with the second inclined surface 76 of the base wall 62. As a result, the force of the impact is distributed over a large surface area of the punch 10*a* (the area of the engaging surfaces 38*a*, 38*b*) and damage to the piercing points P1, P2 and to the cutting surfaces 30*b*, 32*b* of the punch 10*a* is minimized or eliminated by reducing or eliminating the deformation of the piercing points P1, P2 and to the cutting surfaces 30*b*, 32*b*. The piercing points P1, P2 and the cutting surfaces 30*b*, 32*b* do not engage with the first inclined surface 74 as there is a gap 80 between the piercing points P1, P2/cutting surfaces 30*b*, 32*b* and the first inclined surface 74.

The die 60 of the present invention can be easily manufactured. Like the prior art die 40, the die 60 is turned on a lathe. Since the base wall 62 is not flat on its inner surface 72 like the prior art die 40, this die 60 reduces the material removed to make the die 60. There is no associated increase with the material or labor costs to manufacture the present die 60 versus the prior art die 40. The die 60 and the punch to be used therewith, for example punch 10*a*, can be used with all existing manual, electric, and hydraulic wrenches and actuators. The die 60 is interchangeable with the dies already in the field.

While a preferred embodiment of the present invention is shown and described, it is envisioned that those skilled in the art may devise various modifications of the present invention without departing from the spirit and scope of the appended claims.

What is claimed is:

1. A die configured to receive a punch capable of piercing and cutting a workpiece, the die comprising:

a base wall having a perimeter and defining a circumference, an outer surface and an inner surface;

a depending wall extending from the perimeter of the base wall and extending from the inner surface of the base wall such that an interior surface of the depending wall and the inner surface of the base wall form a cavity;

a passageway extending through the base wall; and a central axis extending through the passageway, the outer surface of the base wall being perpendicular to the central axis, the inner surface of the base wall having a first surface portion and a second surface portion, the first surface portion extending between the depending wall and the second surface portion at a first constant angle relative to the central axis and continuously around the circumference of the base wall, the first surface portion directly contacting the depending wall and directly contacting the second surface portion, the first constant angle being greater than 90 degrees, and the second surface portion extending directly from the passageway to the first surface portion at a second constant angle relative to the central axis and continuously around the circumference of the base wall, the second constant angle being greater than 90 degrees, the first angle being greater than the second angle.

2. The die of claim 1, wherein the first angle is 120 degrees and the second angle is 103 degrees.

3. The die of claim 1, wherein the first angle is 120 degrees.

4. The die of claim 1, wherein the second angle is 103 degrees.

5. The die of claim 1, wherein the die is formed of metal.

6. The die of claim 1, wherein the outer surface of the base wall is planar.

* * * * *